United States Patent [19]

Banas

[11] Patent Number: 4,649,767

[45] Date of Patent: Mar. 17, 1987

[54] TRIM LINKAGE

[75] Inventor: Dale Banas, Cleveland, Ohio

[73] Assignee: Cleveland Controls, Incorporated, Cleveland, Ohio

[21] Appl. No.: 782,863

[22] Filed: Oct. 2, 1985

[51] Int. Cl.[4] ..... G05G 11/00; G05G 13/00

[52] U.S. Cl. ..... 74/479; 74/522; 74/834; 251/233; 431/76

[58] Field of Search ..... 74/479, 522, 834; 414/917; 251/233, 234; 431/76

[56] References Cited

U.S. PATENT DOCUMENTS

| | | | |
|---|---|---|---|
| 865,784 | 6/1907 | Kolstram . | |
| 1,844,415 | 2/1932 | Wilhjelm | 74/522 |
| 2,022,511 | 11/1935 | Lewis | 74/522 X |
| 2,834,218 | 5/1958 | Lovell | 74/522 X |
| 2,863,500 | 12/1958 | Schumann | 158/76 |
| 3,013,437 | 12/1961 | Harding | 74/96 |
| 3,103,829 | 9/1963 | Basford | 74/479 |
| 3,330,477 | 7/1967 | Stephens | 235/61 |
| 3,352,167 | 11/1967 | Winters | 74/96 |
| 4,150,939 | 4/1979 | Hayes | 431/76 |
| 4,286,474 | 9/1981 | McMahon, Jr. | 74/522 |
| 4,486,166 | 12/1984 | Nelson et al. | 431/76 |

*Primary Examiner*—Allan D. Herrmann

*Attorney, Agent, or Firm*—Pearne, Gordon, McCoy & Granger

[57] ABSTRACT

A mechanical proportioning trim execution device in the general configuration of a four-bar linkage including input and output levers coupled by a connecting link, with the input lever having its length determined by a movable pivot automatically adjusted by a gear motor to produce the trim function. The movable pivot advances or retracts along a path which is highly skewed to the line of the input lever in a manner such that the path is perpendicular to the connecting link at zero input displacement for minimum trim effect and is parallel to the connecting link at full input displacement for maximum trim effect.

7 Claims, 7 Drawing Figures

TRIM LINKAGE

BACKGROUND OF THE INVENTION

The invention relates to a mechanical linkage for executing proportionate trim in an automatic control system.

PRIOR ART

Control systems in which mechanical proportioning trim execution devices are used typically include primary control means for controlling a controlled element along a range of movement via a mechanical linkage and in response to a primary signal. For example, a boiler may have a primary control means comprising a master controller and linkage means driven thereby for controlling fuel valves and damper settings for the boiler in response to sensed error in steam pressure and along a range of movement from fully closed to fully open position.

Mechanical proportioning trim execution devices are used in such control systems to trim the position of a controlled element in respónse to a secondary signal, with the degree of trim effected by a given secondary signal input being proportional to the degree of advance of the controlled element along its range of movement. For example, in the above boiler control system, the setting of the damper as the controlled element may be trimmed in response to sensed error in oxygen content of flue gases, with the degree of trim effected by a given sensed error being proportional to how far the primary control means has advanced to the fully open position.

Prior art devices have included a "ratio lever" trimmer which has the effective length of its lever adjusted for trim action. The effective length is determined by the location of a nut which travels on a screw aligned with the longitudinal axis of the lever. A trimming motor carried on the free end of the lever turns the screw to automatically adjust the position of the nut. A clevis on the nut couples the ratio lever with a controlled output lever element through an intermediate link.

Another prior art device is disclosed in U.S. Pat. No. 4,286,474 to McMahon, Jr. In this device, input and output shafts are interconnected by a common lever. The fulcrum point for the lever is adjustable along a slot in the lever near its midlength. The slot is slightly skewed with respect to the longitudinal direction of the lever. The fulcrum is part of a nut carried on a screw with its axis generally aligned with the length of the lever. Rotation of the screw by a trimming motor permits the lever to be shifted for positive or negative bias by interaction between the fulcrum and lever slot. The orientation of the slot in the lever is arranged to proportion the effect of a secondary or trim signal in accordance with the degree of advance of a primary control input displacement.

While the latter-described device affords certain advantages over the former, each of these devices requires a significant amount of space for proper operation of their components. A recent trend is the use of relatively small, efficient package boiler systems. Several of such units may be used in a building or complex where in earlier practice only one or two large units would have been specified. Ideally, these manufactured units are small enough to pass through doorways and corridors to simplify building construction and installation procedures. Space requirements of prior proportioning trim control devices can make it difficult to incorporate them in restricted areas such as found in these current package boiler systems.

SUMMARY OF THE INVENTION

The invention provides an automatically controlled trim linkage device which develops trim action that is proportional to the input displacement of a primary control and which, for its force and stroke capacity, occupies a relatively small space. The disclosed trim device has the basic arrangement of a four-bar linkage, including pivotal input and output levers coupled by a connecting link. These levers and link, as well as a trim adjustment gear motor, are contained in a housing which serves as the fourth link of the four-bar linkage. In a typical arrangement, input lever displacement is determined by the primary control means.

The effective length of one of the pivotal levers is adjustable through a screw power-operated by the trim motor and nut to provide the trim function. The axis of the screw is skewed at a relatively large angle with respect to the line of the associated lever. The angular relationship of the screw axis, associated pivotal lever, and connecting link is such that at a low level of input lever displacement the trim screw axis has essentially no component in the line of the connecting link and at a high level of input lever displacement, the trim screw axis has a maximum component in the line of the connecting link.

As a consequence, at low displacement levels of the input and output levers, rotation of the trim screw and resultant displacement of its associated nut pivot center has little trim effect, since the nut produces limited, if any, longitudinal displacement of the connecting link. By contrast, at high displacement levels of the levers, rotation of the trim screw and displacement of the nut has a large trim effect, since substantially all of the travel of the nut is converted into longitudinal displacement of the connecting link.

DESCRIPTION OF THE PREFERRED EMBODIMENT

Figure 1:
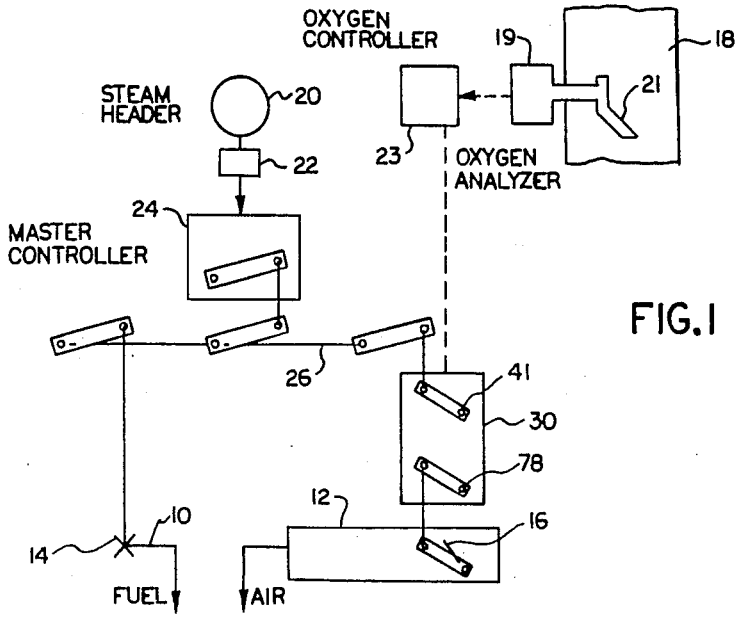
FIG. 1 is a schematic illustration of a boiler firing control system utilizing the invention.

The boiler firing control system in which the invention is used includes a burner (not shown) to which fuel is supplied by the line 10 and air is supplied by a duct 12. The flow of fuel is controlled by valve 14 and the flow of the air by a damper 16. The duct 12 is connected to a suitable blower (not shown). The products of combustion from the burner pass through a stack 18. The burner heats a boiler (not shown) which includes a steam header 20.

A pressure transmitter 22 associated with the steam header 20 senses steam pressure and transmits this information to a master controller 24. The master or primary controller 24 signals any degree of sensed error in steam pressure and correspondingly adjusts a fuel valve 14 and damper 16 via the illustrated linkages, including the jackshaft 26. The fuel valve 14 is directly driven from the jackshaft 26 while the damper 16 is driven by the trim linkage device 30, to be described below. When the trim linkage device 30 is set in neutral position, or at zero trim, movements of the damper 16 correlate with movements of the jackshaft 26 and the fuel valve 14 without the addition or subtraction of significant trimming adjustment.

The trim linkage device 30 is contained in a rigid housing 31, which is in the form of a generally rectangular box having a base plate 32, side walls 33, end walls 34, and a top cover 35. The side walls 33, end walls 34, and top cover 35 are rigidly fixed to one another, and the base plate 32, as by screws.

Within the housing 31, the device 30 includes a pivoted input lever assembly, generally designated at 37, a connecting link 38, and a pivotal output lever 39. The input lever assembly 37 and the output lever 39 and connecting link 38 combine with the rigid housing 31 to form a four-bar linkage.

The input lever assembly 37 is pivotally supported on the housing 31 by an input shaft 41 which extends through opposite side walls 33 of the housing 31 and is pivotal in bearings 42 carried on these side walls. The input lever assembly 37 includes a lower plate 46 and a pair of end plates 47 spaced from one another and extending generally upwardly from the lower plate 46. The plates 46, 47 are fixed to the input shaft 41 by screws 48. Journaled and axially fixed in suitable bearings 49 in the lever end plates 47 is an acme screw or worm gear 51. The screw 51 is power driven in either rotational direction by an electric gear head motor 52. The motor 52 is coupled to the screw 51 by a toothed belt 53 trained over a pulley 54 on a shaft 56 of the gear head motor and a pulley 57 on the screw 51. The motor 52 is fixed relative to the input shaft 41 and input lever assembly 37 by a mounting plate 58 secured to the input shaft by screws 59.

Carried on the screw 51 is a traveling nut 61 that includes a pair of cylindrical trunnions 62 which have their common axis parallel to that of the input shaft 41. With the housing 31 as a frame of reference, the nut trunnions 62 form the free pivot of the input lever assembly 37, while the input shaft 41 forms the fixed pivot of this lever assembly. The limits of travel of the nut 61 on the screw 51 are determined by limit switches 63, 64 tripped by a pin 66 carried on the nut. The switches 63,64 control electrical power to the gear motor 52. The rotative position of the screw 51 is measured electrically by a rotary potentiometer 67 coupled to the screw by a set of intermeshed gears 68, 69 on the potentiometer and screw, respectively. The pivotal or rotative position of the input shaft 41, and therefore the input lever assembly 37, is measured electrically by a rotary potentiometer 71 coupled to the input shaft by a gear 72 fixed on a shaft of the potentiometer and a segment gear 73 on the input shaft.

The connecting link 38 is in the form of a pair of parallel, spaced, elongated elements 38*a*, 38*b* coupling the input lever assembly 37 to the output lever 39. Bearings 74 in one set of ends of the connecting links 38*a*,38*b* are journaled on the nut trunnions 62 and bearings 76 on the opposite set of link ends are journaled on coaxial trunnions 77 on the output lever 39. The output lever 39 is rigidly clamped to the output shaft 78 by a screw 79. The output shaft 78 is parallel to the input shaft 41, and is spaced therefrom on centers a distance substantially equal to the operative length of the connecting link 38, i.e., the center-to-center distance of the bearings 74, 76. The length of the output lever 39 is generally equal to that of the input lever 37 at zero or neutral trim. The output shaft 78 is pivotally supported on the housing 31 by bearings 81 in the side walls 33 and extends through both side walls 33. With the housing 31 as a frame of reference, the trunnions 77 form the free pivot of the output lever 39 and the output shaft 78 forms the fixed pivot of the output lever. The input and output shafts 41,78 extend through the side walls 33 and are square or otherwise acircular in cross section at their exposed ends to permit suitable levers to be fixed thereon.

The trim linkage device 30 is operative to selectively produce an angular displacement of the output lever 39 as a ratio of the angular displacement of the input lever. By way of example, the illustrated device produces an angular output displacement of the output lever 39 that can be selectively varied infinitely in the range between 80 and 98 percent of the angular input displacement of the input shaft 41. The input lever assembly 37 moves, in the illustrated embodiment, in a quadrant of substantially 90 degrees, and the output lever moves through an arc somewhat less than a full quadrant, depending on the desired trim. This adjustment or trimming is advantageously used on the boiler control system of FIG. 1 to obtain high operating efficiency.

Figure 2:
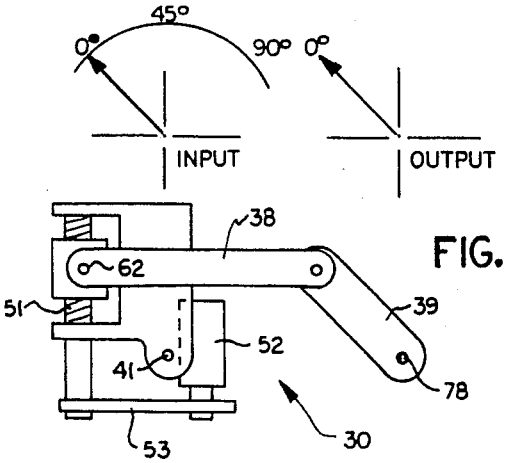
FIG. 2 is a diagrammatic representation of the trim linkage device of the invention at a low displacement condition.
Figure 3:
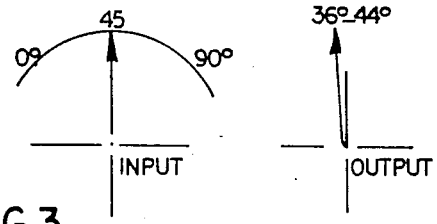
FIG. 3 is a diagrammatic representation of the trim linkage device at a moderate displacement condition.
Figure 4:
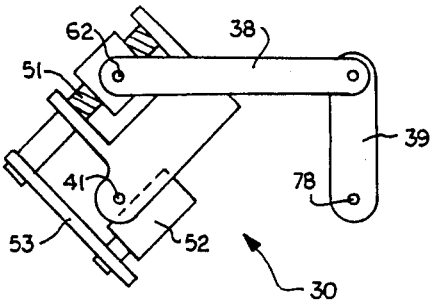
FIG. 4 is a diagrammatic representation of the trim linkage device at a high displacement condition.
Figure 4:
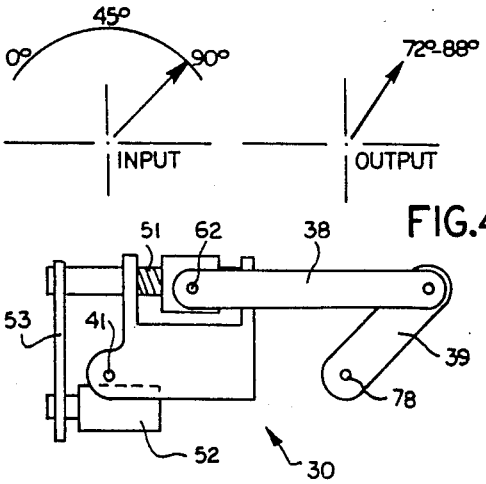
Figure 7:
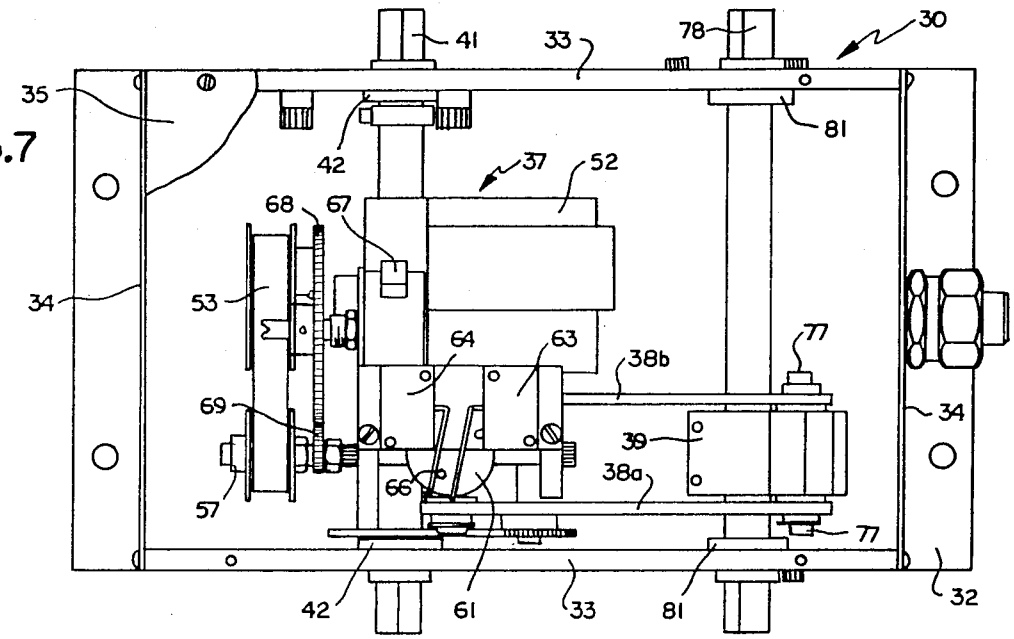
FIG. 7 is a plan view of the device of FIG. 5.
Figure 5:
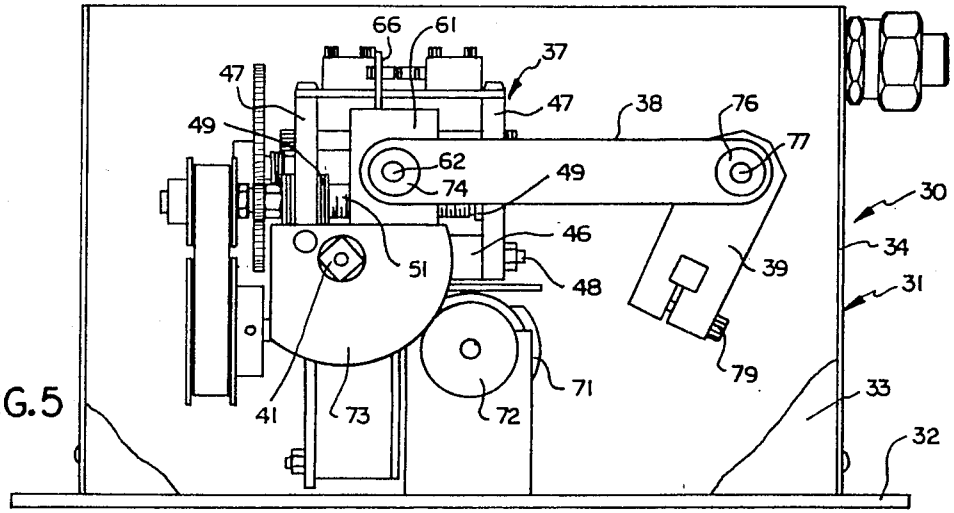
FIG. 5 is a somewhat simplified side elevational view of the trim linkage device of the invention.
Figure 6:
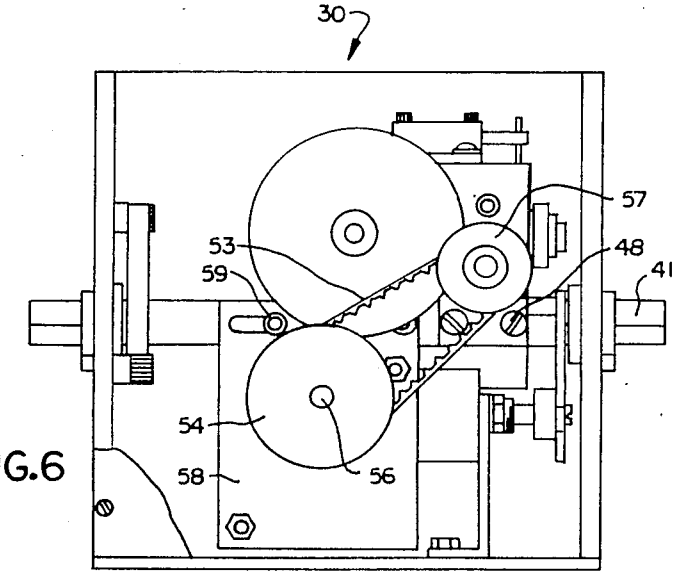
FIG. 6 is an end elevational view of the device of FIG. 5.

FIGS. 2 through 4 illustrate how the effective trim action of the device 30 is proportional to the angular displacement of the input shaft 41 or input lever assembly 37, so that a desired ratio between input and output angular displacement of the input lever assembly 37 and output lever 39 can be maintained substantially constant. Trim can be positive or negative from a reference setting, and is produced by operation of the gear head motor 52 to change the position of the nut 61 on the screw 51. The movement of the nut 61 along the screw 51 changes the effective length of the input lever assembly 37, which is defined as the center-to-center distance between the input shaft 41 and nut trunnions 62. Positive trim can be that which results in an increase in the lever length from that illustrated in FIGS. 2–5. Conversely, negative trim can be that which results in a decrease in this lever length.

Returning to the system shown in FIG. 1, an oxygen analyzer 19 associated with the probe 21 in the stack 18 transmits to oxygen controller 23 information as to the percentage of oxygen content of stack gases. Controller 23 determines any degree of sensed error in percentage oxygen content, and sends a corresponding trim adjusting signal to trim motor 52 of the trim linkage device 30, to thereby trim the position of the damper 16. The trim movement of the screw 51, and therefore the nut 61 and associated elements, is measured by the potentiometer 67, which feeds this information back to oxygen controller 23.

Assume for the purpose of explanation that the control system detects a condition where a 5% increase in air volume is required (this amount to roughly one-half of the maximum possible positive trim since, as previously indicated, the total trim is approximately 18% from full negative to full positive). The gear motor 52 is operated in response to control circuitry to cause the screw 51 to rotate to a rotative position where the nut is approximately half-way between the illustrated neutral position and maximum positive trim. The actual trim effect on the output lever 39 of this given raw trim input signal and corresponding displacement of the nut 61, however, is proportional, in accordance with the invention, on the angular displacement of the pivotal input lever assembly 37. The axis of the screw 51, and therefore the path it provides for the nut 61, is highly skewed, in the illustrated case at 45°, to the nominal line of the lever assembly 37, which is taken as an imaginary line between the input shaft axis and the axis of the nut trunnions 62 where the nut is centered on the length of the screw, as in FIGS. 2–5. At zero or near zero angular displacement of the input lever assembly 37 illustrated in FIG. 2 (e.g., a condition of low fire, with the valve 14 fully closed or nearly fully closed), the skew of the screw 51 on the input lever is such that motion of the nut 61 has a zero or nearly zero component in the direction of the connecting link 38. Thus, lengthening of the input lever assembly 37 (or shortening in the case of negative trim) has no, or essentially no effect on the angular displacement of the output lever 39.

FIG. 3 illustrates the input lever 37 at a midpoint in its angular displacement corresponding to a condition of moderate fire. In this situation, movement of the nut 61 along the screw 51 from the illustrated condition of neutral trim in FIG. 3 for the 5% positive trim example has a measurable component in the direction of the connecting link 38, so that a proportional trim addition to the angular displacement of the input lever assembly 37 will be produced at the output lever 39. The diagram in the upper part of FIG. 3 indicates that with a 45-degree angular displacement of the input lever assembly 37, the output lever 39 displacement can be varied between 36 and 44 degrees from full negative to full positive trim, respectively.

FIG. 4 illustrates the input lever assembly 37 at its full maximum angular displacement corresponding to high fire. In this situation, movement of the nut 61 along the screw 51 from the illustrated condition of neutral trim for the 5% positive trim example has substantially full effect in moving the connecting link 38 in the direction of the connecting links so that the trim effect is at a maximum in adding to the angular displacement of the input lever assembly 37 to produce output lever displacement. The diagram at the upper part of FIG. 4 indicates that with a 90-degree angular displacement of the input lever assembly 37, output lever angular displacement is varied between 72 degrees and 88 degrees from full negative to full positive trim, respectively.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. In an automatic control system, primary control means for controlling a controlled element along a range of movement via a mechanical linkage and in response to a primary signal, and trim linkage means for trimming the position of the controlled element in response to a secondary signal with the degree of trim effected by a given secondary signal input increasing with the degree of advance of said controlled element along said range of movement, the improvement wherein the trim linkage means comprises input and output lever means each movable back and forth in a succession of angular positions through approximately a quadrant of swinging movement, a connecting link joining said lever means, said link being joined to said input lever means at an input pivot and to said output lever means at an output pivot, pivot-shifting means for shifting one of said pivots along a path that, with respect to the lever means associated with such one pivot, is angularly displaced from both the radial and tangential directions in such a way that at one extreme of the quardrant of movement of said associated lever means said path is approximately normal to said connecting link and at said other extreme of said quadrant of movement said path is approximately parallel to said connecting link, and motor means responsive to said secondary signal for advancing or retracting said pivot shifting means along said path to effect varying degrees of trim.

2. An automatic proportional trim control system comprising an input lever pivotal in an arc about a fixed axis between a zero position and a full displacement position, a movable pivot carried on the input lever, a connecting link connected to said movable pivot and extending generally crosswise to the input lever, means supporting said movable pivot on said input lever for movement along a path fixed with respect to said input lever between maximum and minimum positions, said path being skewed with respect to the line of the lever represented by an imaginary line between its fixed pivot and a midpoint of the path, said path being skewed with respect to said line through a substantial angle, motor means operably connected to said movable pivot to move said movable pivot along said path selectively back and forth to trim said linkage, when said lever is in said zero position, movement of said pivot along said path having reduced effect in moving said connecting link lengthwise and when said lever is in its full displacement position movement of said pivot along said path producing a substantially corresponding lengthwise movement of said connecting link.

3. A control system as set forth in claim 2, wherein said path is a straight line.

4. A control system as set forth in claim 3, including a screw having a longitudinal axis forming said path, said motor means being arranged to rotate said screw about its longitudinal axis.

5. A control system as set forth in claim 4, including a traveling nut disposed in said screw, said movable pivot being carried on said nut.

6. A control system as set forth in claim 2, wherein said connecting link is pivotally connected to the free end of an output pivot lever.

7. An automatic trim linkage device comprising a four-bar linkage, said linkage including a frame forming one link, input and output lever means pivotal on the frame about spaced, parallel axes, each between two respective limits of motion, and a connecting link coupling said input and output lever means at pivots adjacent their free ends, the pivot adjacent the free end of one of said lever means being mounted for movement along a path on such lever means, motor means for selectively driving said movable pivot in either direction along said path, said path being highly skewed relative to the line of said one lever means in an angular direction which adjacent one limit of motion of said one lever means is generally perpendicular to the connecting link and at the other limit of motion of said one lever is generally parallel to said connecting link.

* * * * *